US007832481B2

(12) United States Patent
Martindale

(10) Patent No.: US 7,832,481 B2
(45) Date of Patent: Nov. 16, 2010

(54) FLUID PERFORATING/CUTTING NOZZLE

(76) Inventor: James G. Martindale, P.O. Box 2176, Elk City, OK (US) 73648

( * ) Notice: Subject to any disclaimer, the term of this patent is extended or adjusted under 35 U.S.C. 154(b) by 231 days.

(21) Appl. No.: 12/222,945

(22) Filed: Aug. 20, 2008

(65) Prior Publication Data

US 2010/0044025 A1 Feb. 25, 2010

(51) Int. Cl.
*E21B 43/114* (2006.01)

(52) U.S. Cl. ..... 166/298; 166/55; 166/55.7; 175/424; 239/600

(58) Field of Classification Search ..... 166/55, 166/298; 175/424; 239/592, 600
See application file for complete search history.

(56) References Cited

U.S. PATENT DOCUMENTS

| | | | | |
|---|---|---|---|---|
| 3,130,786 | A * | 4/1964 | Brown et al. | 175/424 |
| 3,529,684 | A * | 9/1970 | Hill | 175/424 |
| 4,131,236 | A | 12/1978 | Saunders | 239/589 |
| 4,603,750 | A * | 8/1986 | Sorenson | 175/340 |
| 5,499,678 | A * | 3/1996 | Surjaatmadja et al. | 166/298 |
| 6,564,868 | B1 | 5/2003 | Ferguson et al. | 166/298 |
| 7,140,444 | B2 | 11/2006 | Mackay | 166/380 |
| 7,168,491 | B2 * | 1/2007 | Malone et al. | 166/298 |
| 7,497,259 | B2 * | 3/2009 | Leising et al. | 166/297 |
| 2003/0029308 | A1 | 2/2003 | Van Drentham-Susman et al. | 91/435 |
| 2004/0074994 | A1 | 4/2004 | Ganzer | 239/533.1 |
| 2007/0161341 | A1 | 7/2007 | Kosters | 451/102 |
| 2008/0066913 | A1 | 3/2008 | Lynde et al. | 166/298 |

FOREIGN PATENT DOCUMENTS

| | | |
|---|---|---|
| JP | 6063900 | 3/1994 |
| SU | 799946 | 1/1981 |
| SU | 1100003 | 6/1984 |
| SU | 1243831 | 7/1986 |
| SU | 1311871 | 5/1987 |
| WO | WO 2008/061071 A2 | 5/2008 |

OTHER PUBLICATIONS

"Abrasive Waterjet Cutting", Kennametal, http://www.kennametal.com/uk/PRODUCTS/products_sub2.jhtml;jsessionid=, 2 pages printed from internet.

* cited by examiner

*Primary Examiner*—Giovanna C Wright
(74) *Attorney, Agent, or Firm*—Richard C. Litman

(57) ABSTRACT

The fluid perforating/cutting nozzle is configured to provide long life to the nozzle. The nozzle is composed of a cylindrical shaft defining a bore for the passage of cutting fluid and having inlet and outlet ends, a shank portion and a relatively large diameter shroud disposed on the outlet end. The shroud protects both the nozzle and the tool from the high pressure cutting fluid reflecting off the surface of a workpiece.

12 Claims, 7 Drawing Sheets

FLUID PERFORATING/CUTTING NOZZLE

BACKGROUND OF THE INVENTION

1. Field of the Invention

The present invention relates to fluid jet cutting systems, and more particularly to a fluid perforating/cutting nozzle configured for high endurance and wear resistance.

2. Description of the Related Art

In the oil and gas industry, it is often necessary to perforate or sever tubing employed during drilling operations. Fluid jet cutters are typical cutting systems utilized for such purposes due to their versatility in configuration for specific tasks and relatively low material requirements. The cutting fluid is usually a mixture of water and abrasive that is pumped to a fluid jet cutting nozzle at a very high pressure, e.g., about 3000 psi or higher. One of the difficulties arises from the design of a conventional fluid jet cutting nozzle. During a fluid jet cutting operation, the conventional nozzle experiences splashback, i.e., fluid reflecting back towards the nozzle as the cutting fluid contacts the work surface. This causes the nozzle and the tool to wear relatively quickly due to the high kinetic energy in the cutting fluid splashback and the relatively close spacing between the nozzle and the work surface in which these tools normally operate, the close spacing providing little room to avoid the angle of attack from the splashback. Worn nozzles and/or tools must be replaced or retooled, which creates significant downtime and incur undesirable additional costs.

Thus, a fluid perforating/cutting nozzle solving the aforementioned problems is desired.

SUMMARY OF THE INVENTION

The fluid perforating/cutting nozzle is composed of a substantially cylindrical shaft having an inlet port, an outlet port and a shroud, flange or splash guard formed at the outlet port end. The splash guard is a barrier that provides a much greater surface area and material for the splashback to hit. Thus, the nozzle and the tool are significantly protected from wear.

Another aspect of the fluid jet cutting nozzle is the tool to which the nozzle will be mounted and the process of making the mount for the nozzle. Due to the unique features of the nozzle, the nozzle mount of the tool is configured to accommodate these unique features.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
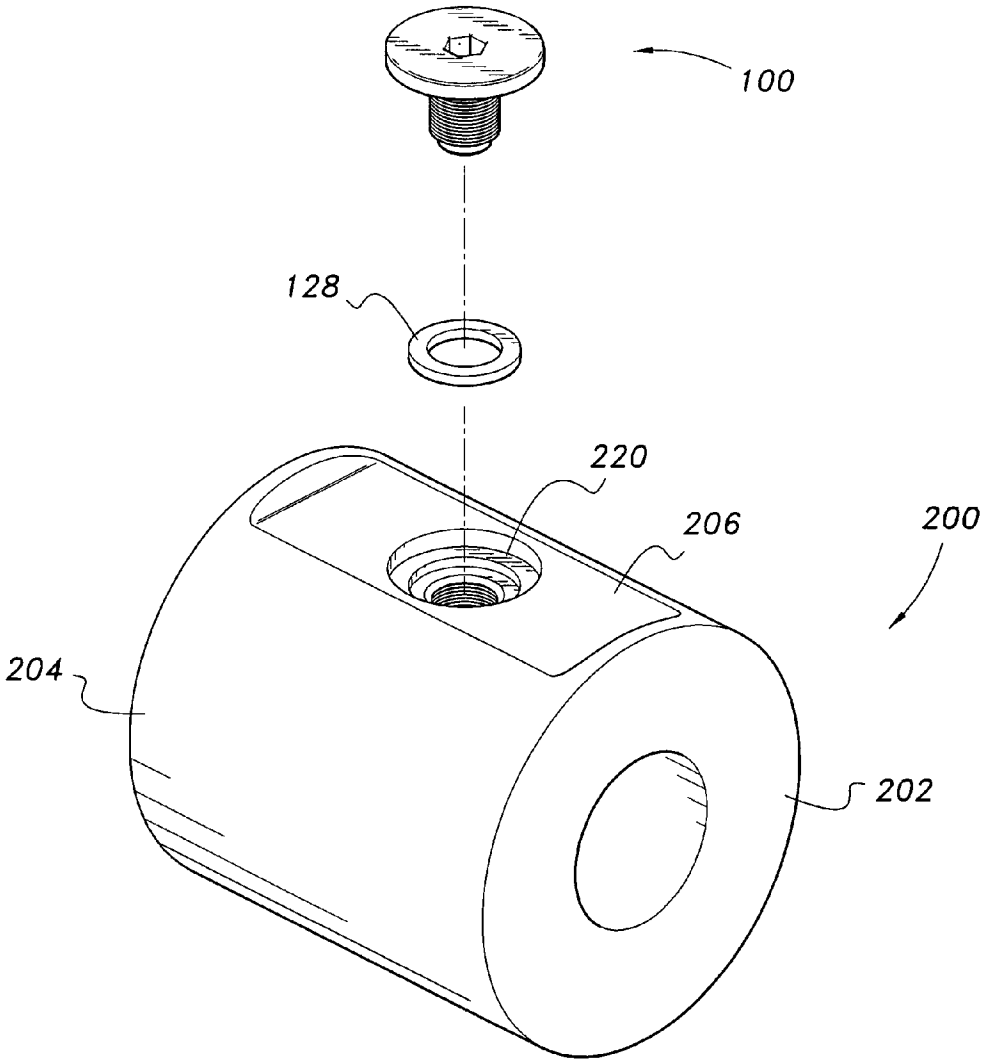
FIG. 1 is an exploded, perspective view of a fluid perforating/cutting nozzle according to the present invention, also showing an exemplary tool on which the nozzle may be mounted.
Figure 2:
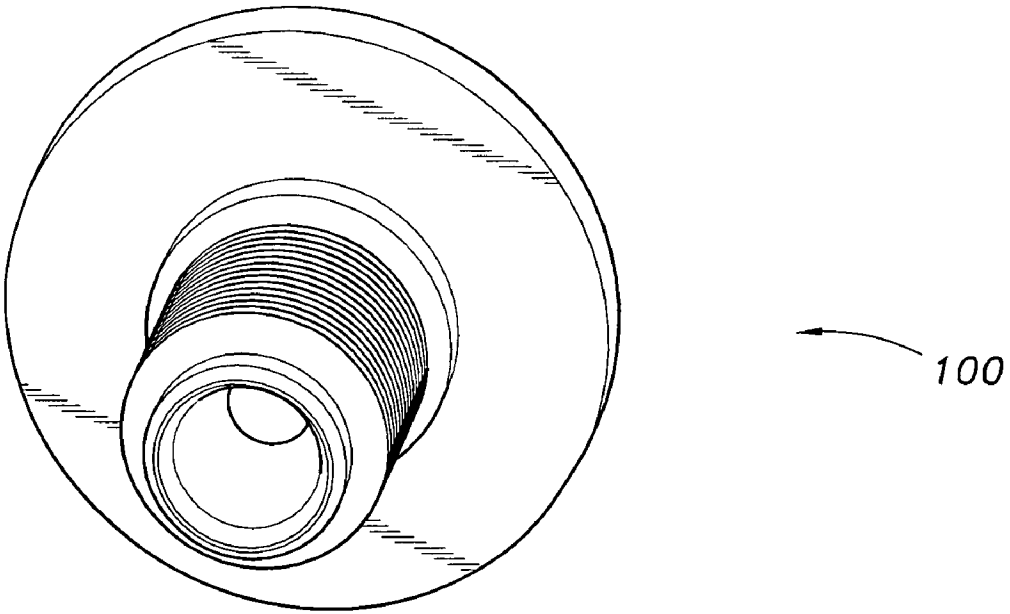
FIG. 2 is a bottom perspective view of the fluid perforating/cutting nozzle according to the present invention.
Figure 3:
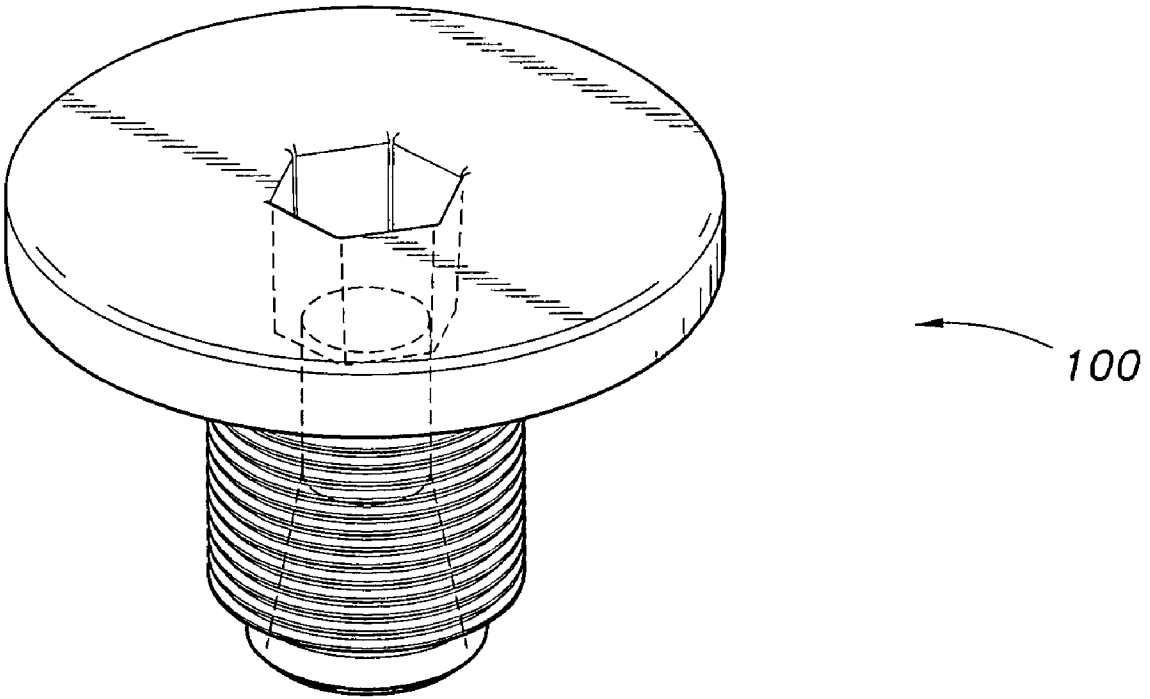
FIG. 3 is a top perspective view of the fluid perforating/cutting nozzle according to the present invention.

The present invention relates to a fluid jet perforating/cutting nozzle 100 and to a tool mount for attaching the nozzle 100 to an exemplary tool 200. As shown in FIGS. 2-5, and particularly referring to FIG. 4, the nozzle 100 is composed of a substantially cylindrical shaft 102 having an inlet end 106 and an outlet end 110. The inlet end defines an inlet port 108, and the outlet end defines an outlet port 112. The high pressure cutting fluid supplied from the tool flows into the inlet port 108 and exits through the outlet port 112. The cylindrical shaft 102 has a threaded shank portion 104 that is used to mount the nozzle 100 onto the tool 200. In this embodiment, the thread length is about 0.477 in.

Figure 4:
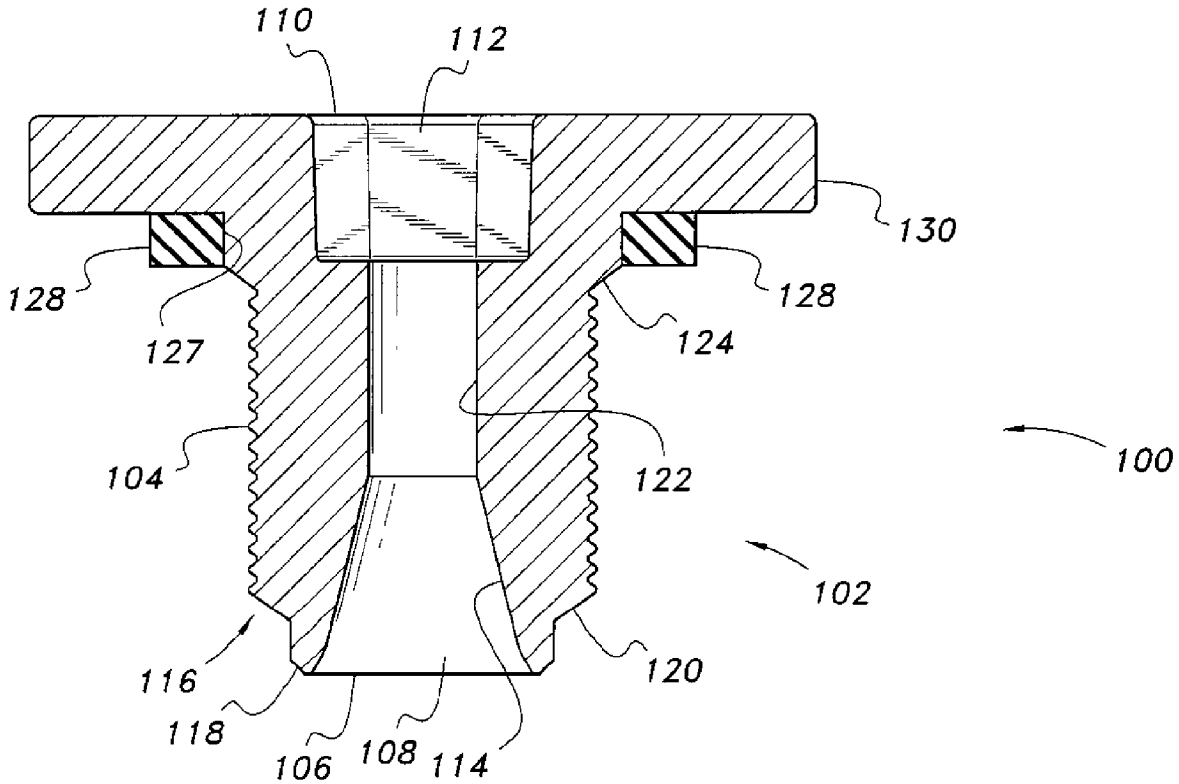
FIG. 4 is an elevational section view of the fluid perforating/cutting nozzle according to the present invention.
Figure 6:
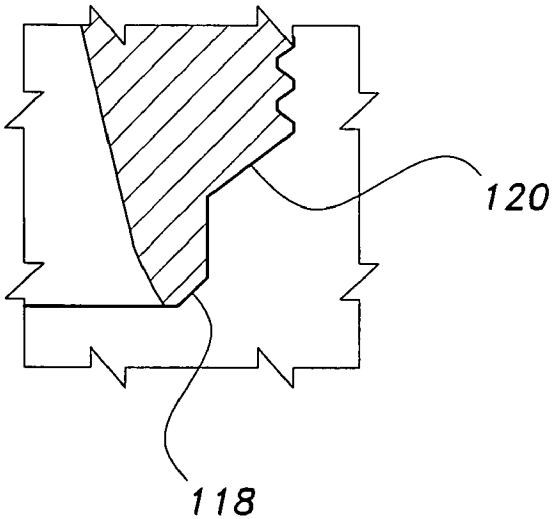
FIG. 6 is a detailed section view of the lip portion of the fluid perforating/cutting nozzle according to the present invention at the inlet end of the nozzle.

Referring to FIGS. 4 and 6, the inlet port 108 has a machined or press-formed conical surface 114 that slightly flares out towards the bottom of the shaft 102. The angle of the slope is about 26° with respect to the longitudinal axis of the shaft 102. This angle can be varied, depending on the requirements for a specific task and the involved manufacturing processes for the nozzle. In a high pressure fluid jet cutting environment, it is desirable to minimize spray of the cutting fluid at the outlet end, since a coherent stream provides a better cutting characteristic. The sloping surface, as well as the smoothness thereof, directs the cutting fluid to form a coherent stream. Moreover, the smooth internal surfaces of the nozzle 100 reduce wear from abrasive particles traveling therethrough. The inlet end 106 has a lip 116 terminating at a first angled shoulder 120. The outer portion of the lip 116 is chamfered at 118 to eliminate burrs that may have formed during manufacturing of the nozzle 100. The first angled shoulder 120 is disposed at about 30° with respect to horizontal, and the angular disposition provides a self-centering benefit to the nozzle 100 when seating the nozzle 100 on the tool 200.

In the orientation shown in FIG. 4, a longitudinally extending center bore 122 is disposed intermediate of the inlet and outlet ends 106, respectively. The bore 122 forms part of the outlet port 112 and has an inner diameter of about 0.125 in.

Figure 5:
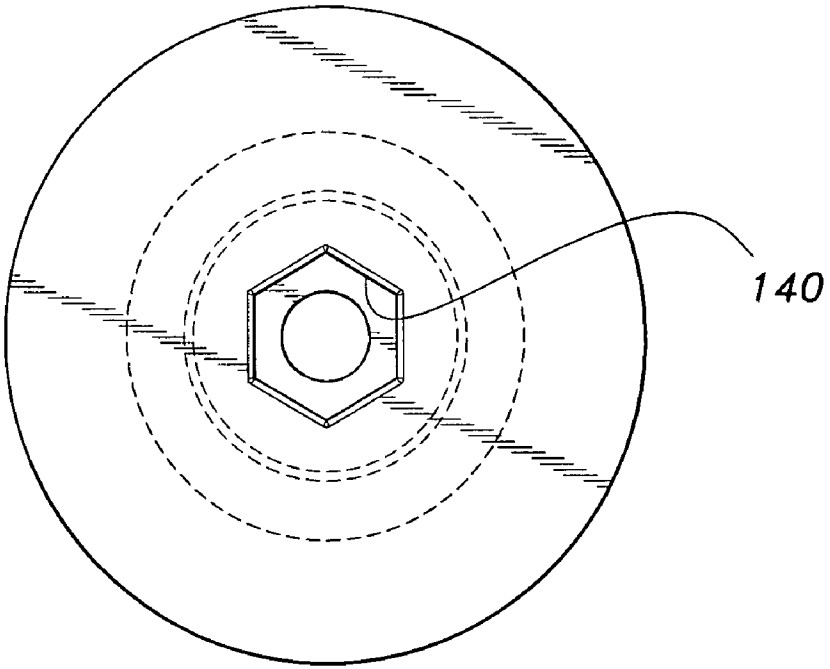
FIG. 5 is a top plan view of the fluid perforating/cutting nozzle according to the present invention.

Referring to FIG. 4, a stepped, second angled shoulder 124 is formed between the shroud 130 and the threaded shank portion. The second angled shoulder forms a shank 127, and an O-ring 128 is mounted in the space between the shank 127 and the underside of the shroud 130. The O-ring 128 provides a seal between the tool 200 and the nozzle 100 when the nozzle 100 is mounted onto the tool 200. The angle of the second angled shoulder is preferably about 30° with respect to horizontal. The outlet end 110 has an outwardly extending flange that forms the shroud 130. As shown in FIG. 5, the shroud 130 is disk-shaped, providing a large protective surface area to catch any splashback. The shroud 130 is preferably about 0.085-0.125 in. thick, with an outside diameter of about 0.875-1.5 in. With the shank diameter being approximately 0.477 in. it can be seen that the outside diameter of the shroud is at least 1.75 times the shank diameter (0.875/0.477). The larger diameter shroud thus forms an effective barrier that provides a much greater surface area and material for the splashback to hit. Thus, the nozzle and the tool are significantly protected from wear.

Figure 7:
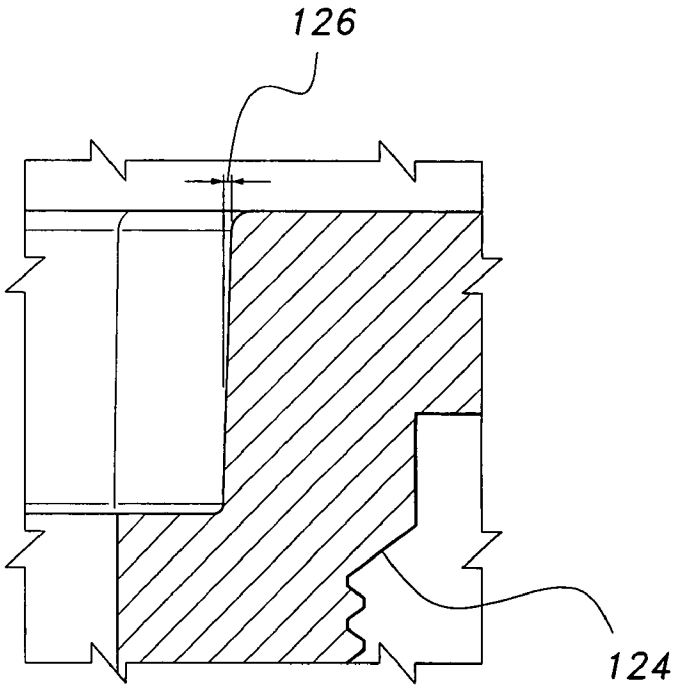
FIG. 7 is a detailed section view of the shoulder portion of the fluid perforating/cutting nozzle according to the present invention at the outlet end of the nozzle.

Referring to FIGS. 4, 5 and 7, a hexagonal aperture 140 is formed at the outlet end 110 of the nozzle 100. The aperture 140 extends toward the central bore 122 at a slight taper or angle, designated by reference number 126. The shape of the aperture 140 accommodates an Allen wrench, which is used to thread the nozzle 100 onto the tool 200. The slight angle 126 provides necessary clearance for insertion of the Allen wrench.

Figure 8:
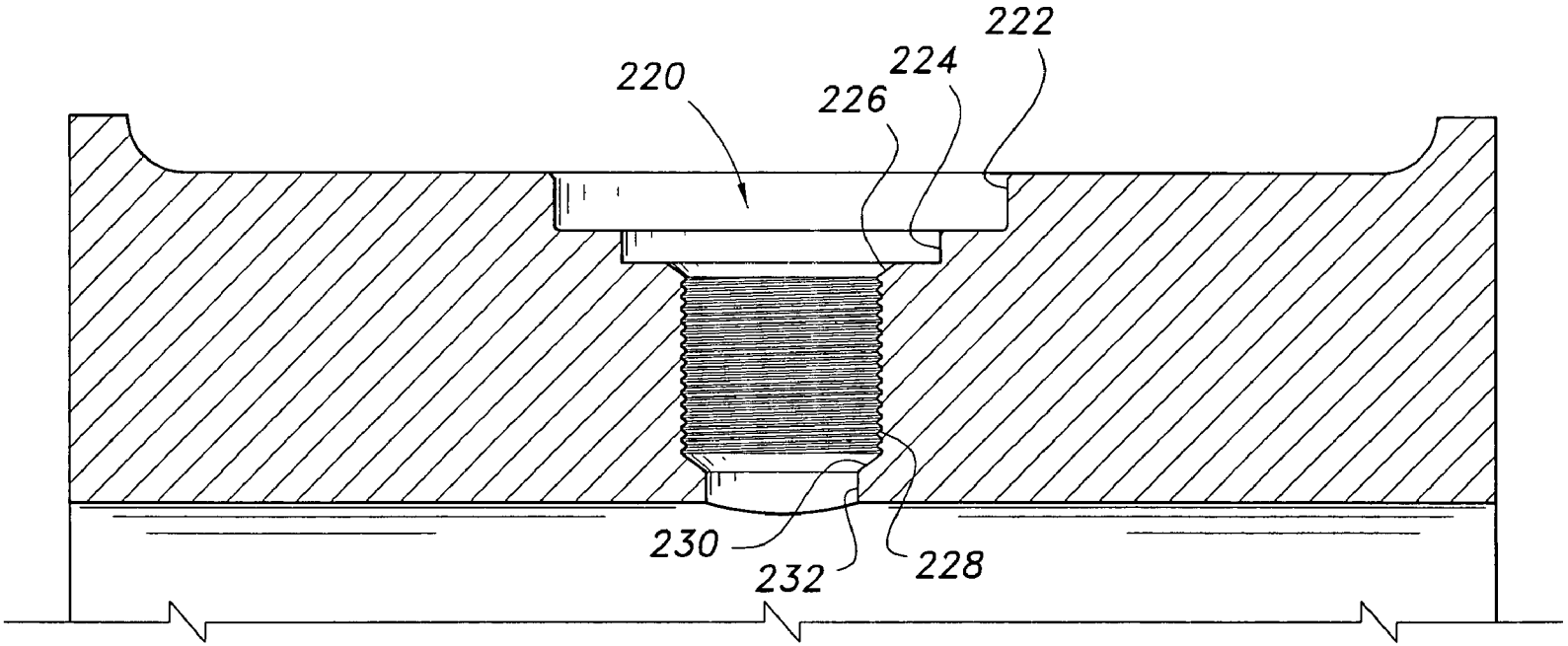
FIG. 8 is a partial environmental section view of the fluid perforating/cutting nozzle according to the present invention mounted on an exemplary tool, showing details of the mounting structure.

Referring to FIGS. 1 and 8, the tool 200 may be composed of a substantially cylindrical housing 202 having an outer surface 204. A portion of the outer surface 204 is machined to form a flat surface 206. A nozzle mount pocket 220 is centrally located on the flat surface 206. The pocket 220 contains, among other things, various stepped recesses that conform and correspond to features of the nozzle 100. As shown in FIG. 8, and viewing these features from the surface 206 to the inner surface of the cylindrical housing 202, the first recess 222 is a depression extending to a depth corresponding to the thickness of the shroud 130. The second recess 224 is another depression forming a seat for the O-ring 128. A chamfer 226 of about 60° with respect to horizontal is formed to conform to the shape of the second shoulder 124 of the nozzle. Threads 228 are tapped and extend downwardly to the formed chamfered surface 230 and a bore 232.

Due to the specific features of the nozzle 100, the following process has been developed to form the pocket in the tool. First, a blank cylindrical housing is provided. Second, the surface of the housing is machined to form the longitudinally flat surface 206, the dimensions of which are about 3"×1.5". Third, the center of the flat surface 206 is located and drilled. The drill bit is about 0.453 in. diameter. Fourth, the first recess 222 is formed by boring to a predetermined depth, the depth being about 0.125 in. The diameter is about 1.01 in. Fifth, the second recess 224 is formed by boring to a predetermined total depth from the flat surface 206. The total depth is about 0.21 in., and the diameter of the second recess 224 is about 0.812 in. Sixth, the chamfer 226 is formed by a chamfering tool. The major diameter of the chamfer 226 is about 0.60 in. on drilled area. Seventh, a tap forms the threads to a minimum of 0.5 in. full thread. The dimensions of the tap are 2 in., 20 TPI (threads per inch). Eighth, sharp edges or burrs are removed to a maximum of about 0.015 in. chamfer. Finally, the seal area is polished to 32 Ra maximum finish.

As shown above, the protective benefits of the shroud 130 results in a longer lasting fluid jet cutting nozzle. Compared to conventional nozzles, the longer life of the nozzle 100 equates to substantial savings for the user. The size of the shroud 130 also protects the tool body because the shroud 130 covers the majority of the areas that may be hit by splashback.

It is noted that the present invention may encompass a variety of alternatives to the various features thereof. For example, the nozzle 100 is preferably made from tungsten carbide, but other hard, durable materials may be employed. The nozzle 100 may also be provided with a protective coating, which would further increase the erosion resistance and life of the nozzle 100. It is noted that the dimensions mentioned above are exemplary and other dimensions are within the scope of the invention as claimed, such as that the outer diameter of the shrouded nozzle 100 may range from 0.875-2.000 in. and the tool may range from 1.5-15 in. diameter.

It is to be understood that the present invention is not limited to the embodiments described above, but encompasses any and all embodiments within the scope of the following claims.

I claim:

1. A fluid perforating/cutting nozzle, uprising consisting of:

a one-piece nozzle, including:

i) a substantially cylindrical shaft having an inlet end, outlet end and a shank portion, the shaft defining a bore for the passage of cutting fluid therethrough, the shank portion having a shank diameter; and ii) a shroud disposed at the outlet end, the shroud having a shroud diameter, the shroud diameter being at least 1.75 times greater than the shank diameter to thereby protect the nozzle from excessive wear due to cutting fluid splashback.

2. The fluid perforating/cutting nozzle according to claim 1, further comprising a mounting assembly formed on the shank for mounting the nozzle on a tool.

3. The fluid perforating/cutting nozzle according to claim 2, wherein said mounting assembly comprises external threads formed on said shank.

4. The fluid perforating/cutting nozzle according to claim 1, wherein said inlet end defines an inlet port and has an axially extending lip.

5. The fluid perforating/cutting nozzle according to claim 4, wherein said inlet port axially tapers toward the inlet end, forming a conical inner surface.

6. The fluid perforating/cutting nozzle according to claim 5, wherein said lip has an outer diameter, the lip outer diameter being smaller than both the shroud diameter and the shank diameter.

7. The fluid perforating/cutting nozzle according to claim 4, wherein the inlet end has a first angled shoulder disposed between said lip and said shank portion.

8. The fluid perforating/cutting nozzle according to claim 1, wherein the bore includes an elongate central bore between said inlet and outlet ends.

9. The fluid perforating/cutting nozzle according to claim 1, wherein a stepped, second angled shoulder is formed between said shroud and said shank portion, said shank and an undersurface of said shroud forming a mounting space for a sealing assembly.

10. The fluid perforating/cutting nozzle according to claim 1, wherein the outlet end has a shaped aperture defined therein axially extending towards the inlet end, the shape of said aperture being adapted for accommodating a mounting tool.

11. A fluid perforating/cutting tool comprising:

a substantially cylindrical body having a surface;

a substantially elongate, flat surface formed on the body surface;

a nozzle mounting pocket centrally disposed on the flat surface; and a nozzle mounted in the pocket; the nozzle having:

a substantially cylindrical shaft having an inlet end, outlet end and a shank portion, the shaft defining a bore extending therethrough, the shank portion having a shank diameter;

a shroud disposed at the outlet end and having a shroud diameter, the shroud diameter being substantially greater than the shank diameter to thereby protect the nozzle from excessive wear due to cutting fluid splashback; and wherein said nozzle mounting pocket has a first recess having a diameter and a second recess stepped below the first recess, the second recess having a diameter smaller than the first recess diameter, the second recess defining a seal seat, the perforating cutting tool further comprising a seal disposed in the seal seat.

12. The fluid perforating/cutting tool according to claim 11, wherein the pocket further has an internally threaded bore extending below the second recess.

* * * * *